US006147580A

United States Patent [19]

Rettew et al.

[11] Patent Number: 6,147,580

[45] Date of Patent: Nov. 14, 2000

[54] STRIP WOUND INDUCTION COIL WITH IMPROVED HEAT TRANSFER AND SHORT CIRCUIT WITHSTANDABILITY

[75] Inventors: Richard Raymond Rettew, Fort Mill, S.C.; Scott Frederick Lett, Monroe; Philip John Hopkinson, Charlotte, both of N.C.

[73] Assignee: Square D Company, Palatine, Ill.

[21] Appl. No.: 09/222,333

[22] Filed: Dec. 29, 1998

[51] Int. Cl.[7] ..... H01F 27/08; H01F 27/32

[52] U.S. Cl. ..... 336/60; 336/96; 336/205; 336/206; 336/223

[58] Field of Search ..... 336/60, 96, 205, 336/206, 223, 55

[56] References Cited

U.S. PATENT DOCUMENTS

| | | | |
|---|---|---|---|
| 2,998,383 | 8/1961 | Worcester | 336/206 |
| 3,246,271 | 4/1966 | Ford | 336/206 |
| 3,939,449 | 2/1976 | Boyd et al. | 336/206 |
| 5,267,393 | 12/1993 | Purohit et al. . | |
| 5,383,266 | 1/1995 | Soter . | |
| 5,396,210 | 3/1995 | Purohit et al. . | |
| 5,461,772 | 10/1995 | Puri . | |

*Primary Examiner*—Thomas J. Kozma
*Attorney, Agent, or Firm*—Michael J. Femal; Larry I. Golden

[57] ABSTRACT

An improved low voltage winding for dry insulated transformer has its windings resin encapsulated. The winding is constructed with flexible sheet conductors wound coincident with an insulating sheet material. Insulating spacers provide a means to form air channels in the windings during the coil forming process. A sealant is applied to openings at the lower ends and along vertical seams of the coil prior to the resin impregnation and encapsulation process. This will prevent drainage of the resin during a curing cycle. The result is a coil that exhibits high short circuit protection due to the tightly bond sheet conductors which will prevent movement of the conductors during short circuit conditions and also increases the radial compressive strength of the coil.

10 Claims, 5 Drawing Sheets

STRIP WOUND INDUCTION COIL WITH IMPROVED HEAT TRANSFER AND SHORT CIRCUIT WITHSTANDABILITY

TECHNICAL FIELD

Applicant's invention relates generally to a low voltage strip wound coil for use in a transformer, and more particularly, to a method for improving the short circuit withstand ability and heat transferability ratings of the coil.

BACKGROUND ART

A transformer generally consists of a laminated, ferromagnetic core, high voltage windings, and low voltage windings. The windings of dry type transformers with primary voltages over 600 volts have generally been constructed using one of three types of techniques : conventional dry, resin encapsulated, or solid cast. The conventional dry method uses some form of vacuum impregnation with a solventless type varnish on a completed assembly consisting of the core and the coils or individual primary and secondary coils. Some simpler methods required just dipping the core and the coils in varnish without the benefit of a vacuum. The resulting voids or bubbles in the varnish that are inherently a result of this type of process due to moisture and air, does not lend itself to applications above 600 volts. The resin encapsulated method encapsulates a winding with a resin with or without a vacuum but does not use a mold to contain the resin during the curing process. This method does not insure complete impregnation of the windings with the resin and therefore the turn to turn insulation and layer insulation must provide the isolation for the voltage rating without consideration of the dielectric rating of the resin. The solid cast method utilizes a mold around the coil, which is the principal difference between it and the resin encapsulated method. The windings are placed in the mold and impregnated and/or encapsulated with a resin under a vacuum, which is then allowed to cure before the mold is removed. Since all of the resin or other process material is retained during the curing process, there is a greater likelihood that the windings will be free of voids, unlike the resin encapsulated method whereby air can reenter the windings as the resin drains away before and during curing. Cooling channels can be formed as part of the mold. One type of such a transformer is manufactured by Square D Company under the trademark of Power-Cast transformers. Another example of a cast resin transformer is disclosed in U.S. Pat. No. 4,488,134.

Since the resin used in coating solid cast coils results in a greater solid bond between adjacent conductors than is possible with resin encapsulated coils, solid cast coils exhibit better short circuit strength of the windings. Because the conductors in the coils are braced throughout by virtue of the solid encapsulant, there is less likelihood of movement of the coils during short circuit conditions and short circuit forces are generally contained internally. An added benefit is that by having greater mass, there is a longer thermal time constant with the solid cast type coils and there is better protection against short term overloads.

External bracing, foil-wound coils, or selective geometry in the shape of the coils must be used in the resin-encapsulated method to prevent movement of the coils caused by the forces of short circuit faults. Insulating material wound with the sheet conductors may have an adhesive coated on it to prevent movement of adjacent windings during the resin impregnation process which will allow the various windings to retain a circular shape and to provide a better bond between windings since the various windings are held in place while processing. The resin encapsulated coils generally have lower radial comprehensive strength, poor radial strength, and higher assembly costs. Resin injected into the coils will have a tendency to leak from the coils during the curing cycle, resulting in some voids in the coil.

The resin encapsulated method does however have several distinct advantages over solid cast coils. They are simpler to manufacture than cast resin coils and require less resin and other materials, resulting in less weight and lower costs. Additionally, the cast resin process requires an epoxy resin, which also requires fillers such as glass fibers to provide mechanical strength. The epoxy resins generally are limited to a 185 deg. C. temperature, whereas resin encapsulated coils can utilize polyester resins that can achieve 220 deg. C. ratings. Given these advantages, it would be desirable to produce coil windings for use in transformers and other inductive devices, with the resin encapsulated method if there were a method to increase the strength of the coil windings to prevent movement during short circuits.

The air gap between the high and low voltage coils is dependent on having the same geometry between the outer surface of the inner coil and the inner surface of the outer coil. For non-molded coils, there is generally a distinct bulge at the point where terminations or leads are attached. As a result, the air gap between coils will be uneven. Inductive reactance of a transformer is determined by this air gap, along with the number of turns in the coil and the physical dimensions of the coil. Controlling these factors will result in limiting short circuit currents and thus controlling voltage withstand ratings.

SUMMARY OF THE INVENTION

Accordingly, the principal object of the present invention is to provide a low voltage winding constructed according to the resin encapsulated method which overcomes the above mentioned disadvantages.

Another objective of the invention is to provide a transformer winding constructed according to the resin encapsulated method that will prevent drainage of the resin that will be applied during the resin encapsulation stage.

A further objective of the invention is to provide a method for manufacturing a transformer winding constructed according to the resin encapsulated method which prevents moisture penetration into the windings and which will prevent flashovers due to moisture condensation.

Yet a further objective of the invention is to provide a transformer winding constructed according to the resin encapsulated method utilizing aluminum strip wound windings which will prevent conductor movement during short circuit fault conditions.

In one embodiment of the invention, a low voltage coil is formed on a special cylinder or mandrel with a flat surface on a portion of the cylinder from which one external lead which is welded to a conductor sheet, such as aluminum or copper, will rest during the start of the winding. The flat surface will allow the windings to retain a circular shape. Along with the sheet aluminum, a layer of insulating material will be including during the winding process. The insulating material may have an adhesive coated on it that will prevent movement of adjacent windings during the resin impregnation process, which will allow the various windings to retain a circular shape. In the present invention, the resin will be able to provide a better bond between windings since the various windings are held in place while processing. This bonding will provide extra strength to the windings and prevent movement of them under short circuit conditions. To provide the necessary voltage creep strength ratings, the insulation windings will extend beyond the top and bottom edges of the conductor sheet windings. The space created between the insulating sheets is filled with a dielectric material to control movement of the conductor sheets during short circuit conditions.

At a predetermined number of turns, spacers will be added to form air channels within the windings during the winding process until the desired number of turns has been reached. The inner and outer insulating layers between the channels thusly created extend further beyond the sheet conductors and are reinforced to provide stiffness to prevent collapse of the edges over the cooling channels. This forms a pocket that is filled with a suitable material to prevent moisture and other contaminants from entering and contaminating the coils. The end of the winding will terminate at another flat surface and the other external lead will be attached to maintain the circular shape.

Lastly, the pockets formed on the bottom portions of the coil by the inner and outer insulating layers are sealed with a suitable sealant. Further, all vertical seams in the inner and outer insulating layers are also sealed. This will prevent drainage of the resin that will be applied during the next stage. After the coil is thusly assembled, it will be subjected to a vacuum-pressure impregnation (VPI) process. The coil is then placed in a vacuum chamber that will be evacuated, which will remove the air, and in particular, voids between adjacent windings will be essentially eliminated. A liquid resin is then introduced into the chamber, still under a vacuum, until the coil is completely submerged. After a suitable time interval, which will allow the resin to impregnate the insulation, the vacuum is released and pressure is applied to the free surface of the resin. This will force the resin to impregnate the remaining insulation voids. The coil is then removed from the chamber or the resin from the chamber is drained. The coil is allowed to drip dry and then is placed in an oven to cure the resin to a solid. A further buildup of resin could be accomplished by repeating the process with resins having a higher viscosity to provide the finished coil with a conformal coating for a better appearance and greater isolation from environmental factors.

The completed coil will have superior basic impulse level (BIL) protection since the amount of voids is minimized, short circuit withstand ability is improved since there is little chance of the individual windings moving due to the bonding, and overload capacity is increased since heat generated in the windings will transfer to the cooling ducts better through a solid mass than if voids were present in the windings.

Other features and advantages of the invention will be apparent from the following specification taken in conjunction with the accompanying drawings in which there is shown a preferred embodiment of the invention. Reference is made to the claims for interpreting the full scope of the invention that is not necessarily represented by such embodiment.

DETAILED DESCRIPTION

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

Figure 1:
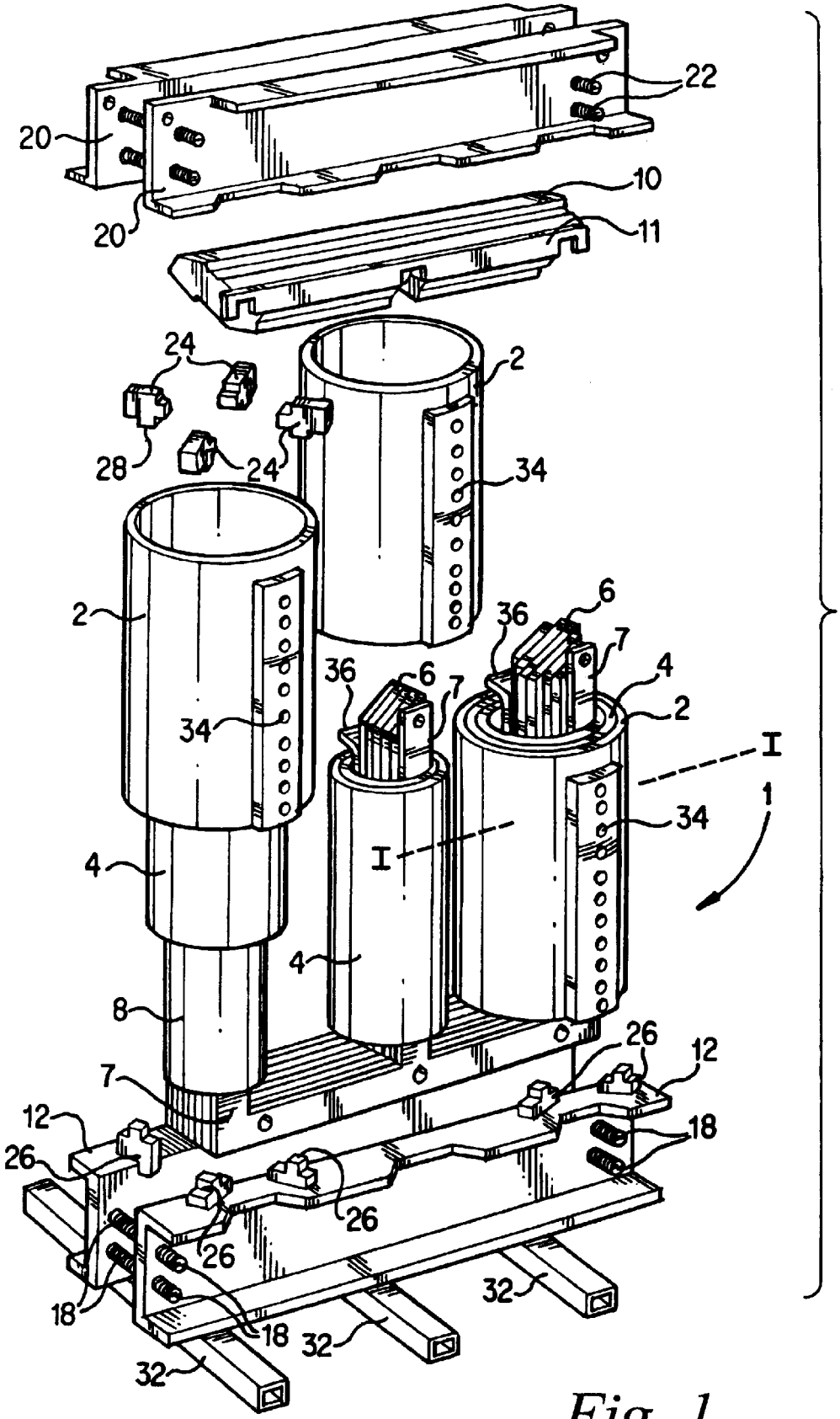
FIG. 1 is an exploded isometric view of a three phase dry-type transformer using a low voltage coil constructed according to the present invention.

FIG. 1 illustrates a typical three phase transformer 1 using a low voltage coil 4 constructed according to the preferred embodiment. Although a three phase transformer is shown, it is to be understood that the invention is not to be limited to three phase construction. A high voltage coil 2 surrounds the low voltage coil 4. The high voltage coil 2 is constructed using a cast resin process, the details of which are well known and are therefore not an object of this invention. U.S. Pat. No. 4,523,171 discloses one such method. The low voltage coil 4 is constructed using a VPI resin encapsulated process, which will be discussed later. A core 6 is formed in the shape of a cruciform from laminated straps of iron for ease of manufacturing. A core locking strap 7 is added to the top of the stack. After the core legs 6 are stacked, various methods, which are not an object of the present invention, are used to keep the core legs compressed. After the core legs are thusly secured, an epoxy type paint is applied to exposed areas for environmental protection. An upper core yolk 10 is secured to the core 6 by mating strap 11 with core locking strap 7 after the low voltage coils 4 and high voltage coils 2 have been inserted over the three legs of the core 6. Lower core clamp 12 holds and secures core 6 through with mounting hardware 18. Upper core clamp 20 holds and secures upper core yolk 8 similarly with mounting hardware 22. Upper 24 and lower 26 mounting blocks support high voltage coil 2 and low voltage coil 4. Tab 28 of mounting blocks 24, 26 maintains an air gap 30 between the coils 2, 4. Mounting feet 32 can be attached for stability. Terminal blocks 34 allow for high voltage connections and have provisions for selected various voltage taps for a wide selection of input and output voltages. Terminals 36 provide the means for low voltage connections. A transformer thus assembled can accommodate input voltages up to 36 kV, with a power rating between 112.5–10,000 kVA.

Figure 2:
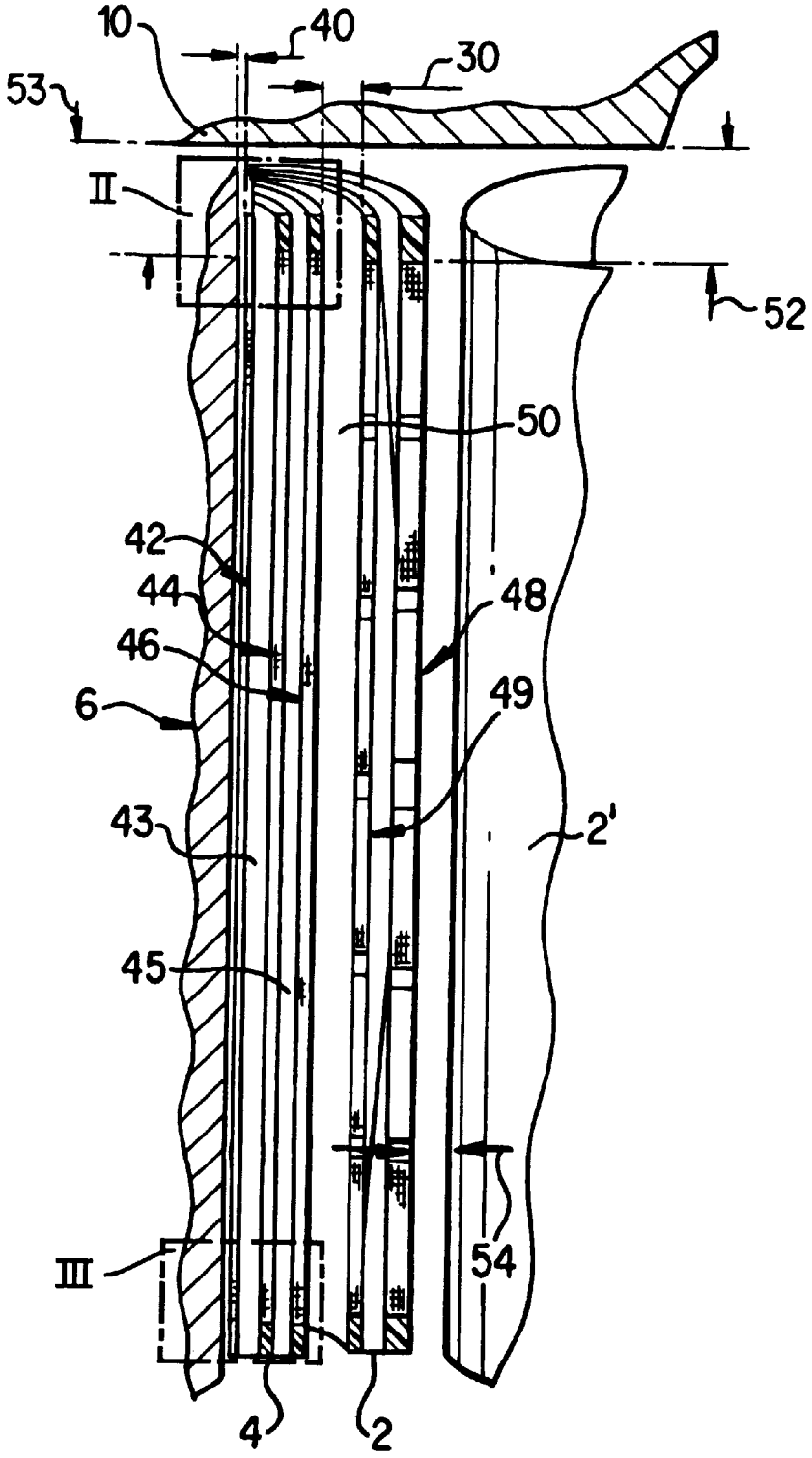
FIG. 2 is a partial cross sectional view of a core surrounded by the low voltage coil constructed according to the present invention, which in turn, is surrounded by a cast resin high voltage coil of the type depicted in the transformer of FIG. 1.

Referring to FIG. 2, a partial cross sectional view of the low voltage coil 4 is illustrated, constructed according to the present invention, which in turn is surrounded by a cast resin high voltage coil of the type depicted in the transformer of FIG. 1. An air gap 40 separates the core leg 6 from the low voltage coil 4. The low voltage coil 4 is composed of multiple windings 42, 44, 46 of flexible sheet conductors such as copper or aluminum, with formed air channels 43, 45 to provide a means of cooling during operation of the transformer 1. Air gap 30 separates the low voltage coil 4 from the high voltage coil 2 with the distance of the gap being determined by the tab 28 on mounting blocks 24, 26 previously mentioned. High voltage coil 2 consists of wire conductors 48, 49, with molded air channels 50. The distance 52 between the top of the conducting materials in coil 2 and the top yolk 10 is chosen to meet high voltage to frame clearances. Likewise, the distance 53 between the top of the conducting materials in coil 4 and the top yolk 10 is chosen to meet the low voltage to frame clearances. Air gap 54 provides isolation between voltage phases.

Figure 3:
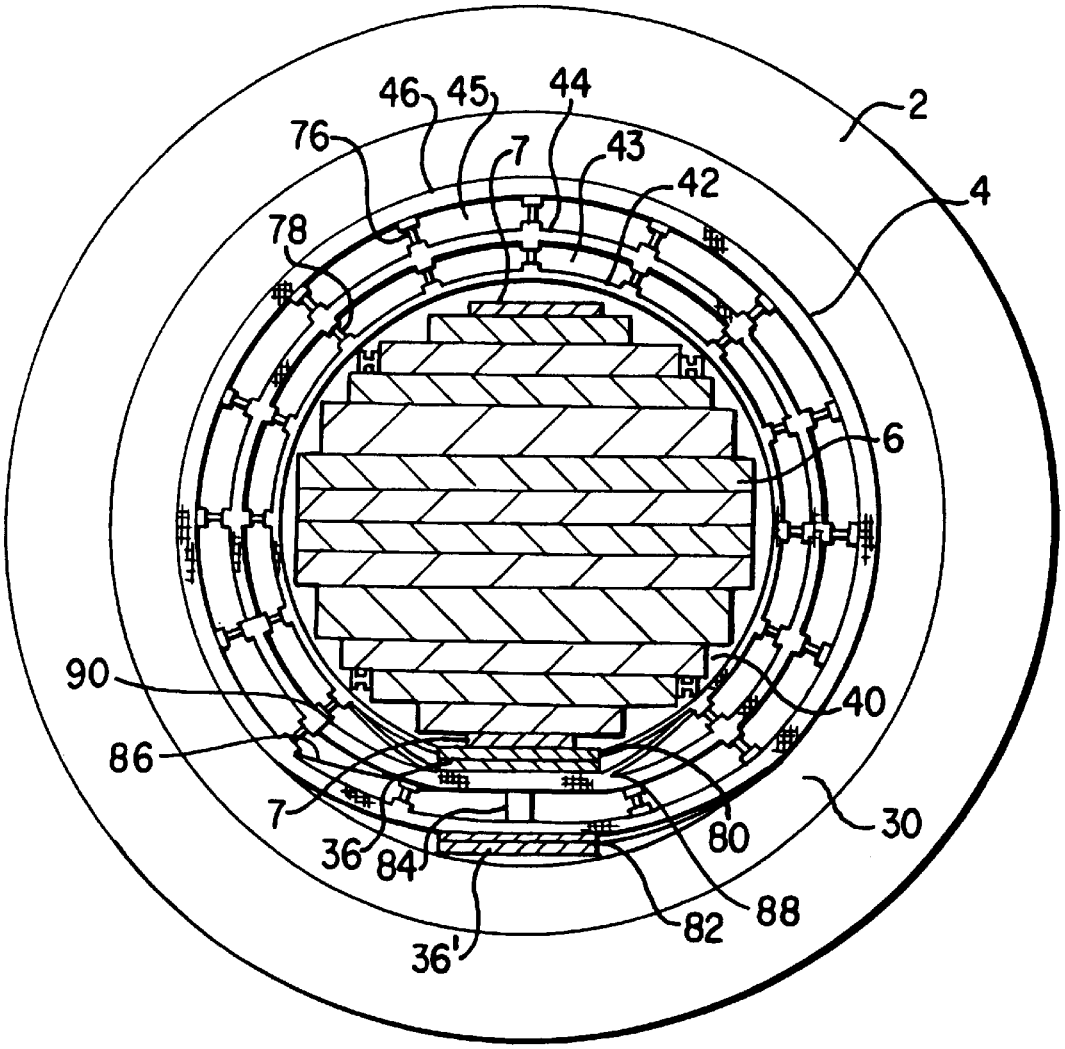
FIG. 3 is a detailed cross sectional view along line I—I of FIG. 1 detailing the low voltage coil of FIG. 2.

The cross sectional view of FIG. 3, taken along line I—I of FIG. 1, provides a more detailed illustration of the preferred embodiment of the low voltage coil 4 of the present invention. The outer or high voltage coil 2 is separated from the low voltage coil 4 by the air gap 30. The essentially circular shape of the low voltage coil 4 allows the air gap 30 to remain constant throughout its entirety which will reduce susceptibility to voltage impulses and will help control impedance changes during short circuit conditions.

Air gap 40 separates the cruciform core leg 6 from the low voltage coil 4. The low voltage coil 4 is composed of multiple windings 42, 44, 46 of flexible sheet conductors such as copper or aluminum, with formed air channels 43, 45 to provide a means of cooling during operation of the transformer 1.

Dogbone spacers 76, 78 are staggered and strategically placed and sized so as to ensure that the final exterior shape at the air gap 30 is circular. The spacers 76, 78 are pultruded glass reinforced polyester. Spacing between adjacent spacers 76, 78 varies from 1.5 inches to 2.5 inches on center. This spacing is critical since air flow in the created air ducts 43, 45 will be restricted if they are too close together, resulting in poorer cooling characteristics. If the spacing is too far, voids could be created between the insulating layers 60 and the sheet conductors 62 that make up the windings 42, 44, and 46. This could result in localized hot spots and decrease the mechanical rigidity of the over coil 4, which could reduce the short circuit withstandability.

Leads 36, 36' are insulated with a creep and strip barrier composed of Nomex or other suitable flexible sheet insulation. This insulation is to prevent voltage breakdown between the low voltage winding 4 and the core 6 or other grounded surfaces. The combination of the flat surfaces 80, 82, and duct stick 84 allow the leads 36, 36' to be contained inside the low voltage coil 4 with no apparent bulge. In addition the leads 36, 36' are bonded to the body of the low voltage coil 4. A glass rope or other suitable material, running parallel to the lead from top to bottom along its major axis is sufficiently porous to absorb resin during the VPI process to provide lead support and reinforcement, preventing movement of the lead from short circuit forces.

Figure 4:
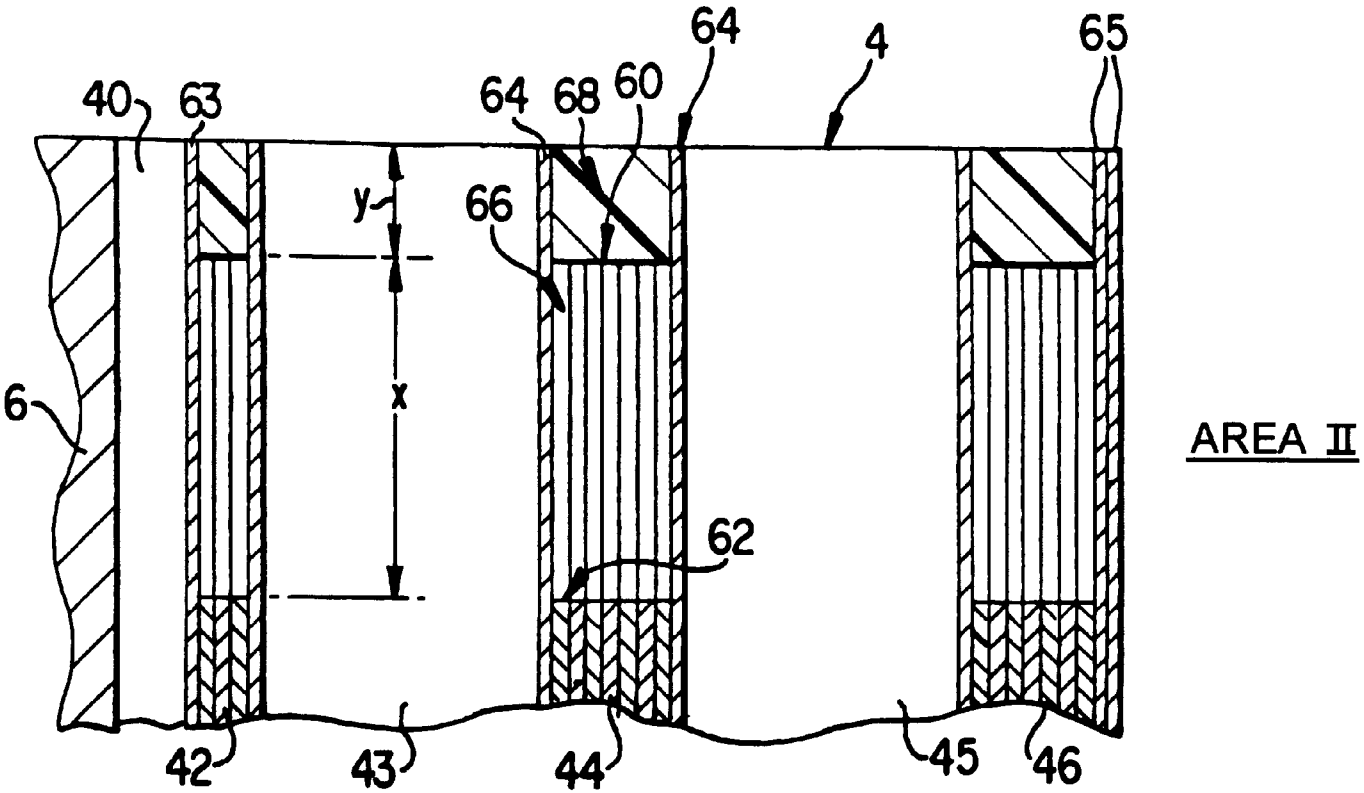
FIG. 4 is an enlarged view of area II detailing the upper portion of the low voltage coil depicted in FIG. 2.

A more detailed view of Area II of FIG. 2 is shown in FIG. 4 to illustrate a means for reinforcing the top and bottom edges of the windings 42, 44, and 46 of the low voltage coil 4. The low voltage coil 4 is composed of multiple laminations of flexible sheet conductors. The description for winding 44 will also hold true for the other two windings 42 and 46. Film insulation sheets such as Nomex form an excellent winding layer insulation system. This layer 60 is extended beyond the edge of the sheet conductors 62, as designated by the distance X for obtaining the necessary creep strength requirements.

The coil is wound from flexible sheet conducting material start at a flat surface 80. Multiple laminations of flex sheet conductor lead are used to form the external leads 36, 36' that are welded to the sheet conductor 62. The leads 36, 36' are deformed during assembly to allow the high voltage coil 2 to be inserted around the coil during final assembly of the transformer 1 and reshaped appropriately after assembly for external connections.

In some types of coils, the insulating layers 60 are coated with a B-staged-thermoset adhesive. Use of the thermoset adhesive allows the layers to become bonded during a preheating process before the VIP process. Using a diamond or similar pattern will create sufficient bonding between the sheet conductors 62 to retain the shape of the coil during the VPI process and still provide sufficient unbonded areas for the resin to impregnate the body of the coil during the VPI process. The type of resin is chosen to provide a suitable temperature index for the intended temperature rise of the coils. In addition it must be able to fill the voids and improve the thermal conduction between the sheet conductors 62 and the heat dissipating surfaces, and lastly, prevent contaminants such as water, oils, acids, and industrial fumes from entering and contaminating the coils.

Previous low voltage coils constructed using the resin encapsulated method did not insure complete impregnation of the windings with the resin and therefore the turn to turn insulation and layer insulation must provide the isolation for the voltage rating without full consideration of the dielectric rating of the resin. This method resulted in low radial compressive strength, poor radial heat transfer, and high assembly costs. The combination of poor radial strength and heat transfer is due in part to drainage of the resin applied after the coil is wound. The extra cost is due to requiring extra bracing of the coil required due to low radial compressive strength. Whereas the use of the insulating layers being coated with the B-staged-thermoset adhesive greatly increases the interlayer bonding, the B-stage resin can only do this where it is in intimate contact with the conductor sheets. Often the various layers of conductor and insulating sheets become distorted and assume different curvatures as they cross the various spacers 76, 78 of FIG. 3, used in forming the air channels 43, 45. This creates gaps between the adjacent layers that are to be filled with the insulating resins during the VPI process. Further, there are vertical seams 86, 88, 90 shown in FIG. 3, formed between by the various layers of conductor sheets 64 and insulating sheets created when forming the air channels 43, 45 and the inside and outside conductor layers 63, 65. These seams can result in leakage of the resin during and after the resin encapsulation process. This resin can also drain out from the bottom of the coil when it is removed from the VPI process and allowed to cure, resulting in a permanent loss and the creation of possible voids within the low voltage coil 4 itself.

Figure 5:
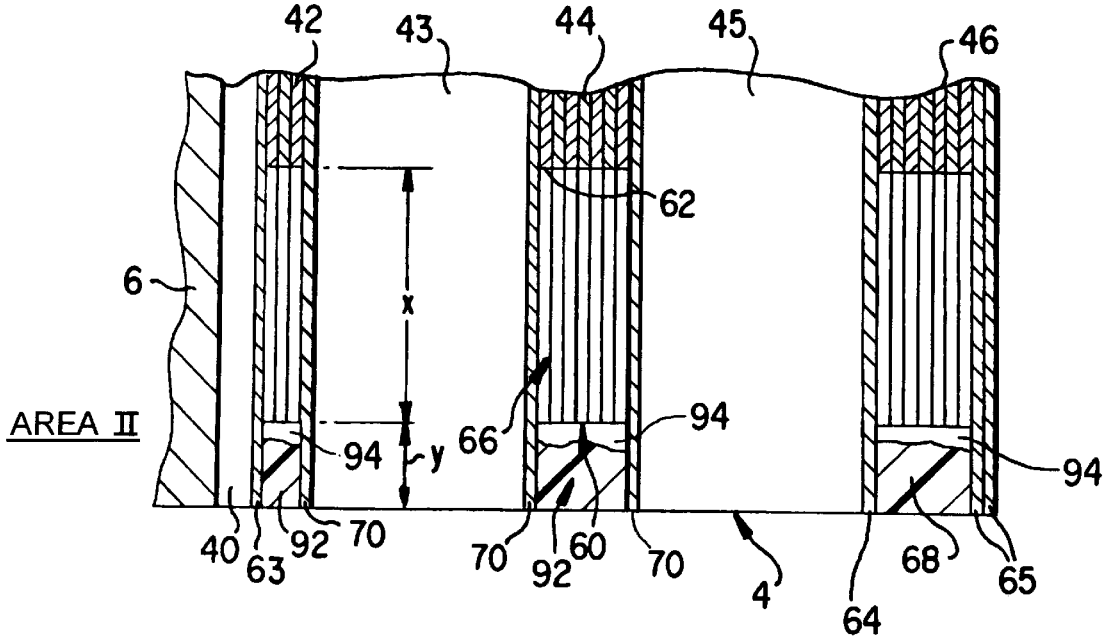
FIG. 5 is an enlarged view of area III detailing the lower portion the low voltage coil of FIG. 2.

To prevent this leakage of resin, before the completed coil assembly is subjected to the resin encapsulation process, the bottom cavity 92 is sealed with a suitable sealant 94 as shown in FIG. 5, which is a more detailed view of Area II of FIG. 2. Likewise, the vertical seams 86, 88, 90 shown in FIG. 3 are also sealed with the same sealant. The sealant chosen is an epoxy having a quick, 3–5 minute cure time. This epoxy should be formulated to be highly thixotropic so that it does not flow into the gap 66 created below the conductor sheet winding 62 and the between the insulating sheets 60. The use of this sealant will prevent the leakage of the resin during and after the resin encapsulation process. Since the injected resin does not seep from the coil during the VPI process and during the curing period, the resultant coil will have greater short circuit withstandability and improved radial heat conduction due to bonding throughout the body of the coil without the need for using an adhesive coating on the insulating winding and without the need for preheating the coil before the start of the VPI process to allow the adhesive to set. This greatly reduces the time and cost required to manufacture the coil.

When winding the insulating layers 60 with the sheet conductors 62, the edges of the layers 60 can collapse due to the soft texture of the material, which could result in blockage of the cooling ducts, limiting the cooling characteristics of the coil. Outside barriers 64 which extend a distance Y beyond the edge of the insulating layers 60, provide the stiffness to prevent this collapse and are selected based on the voltage class of the transformer. For a minimum of a basic impulse level (BIL) of 1 kV, common for an isolation rating between the core 6 and the low voltage coil 4, the inside barrier 63 will be one thickness of 0.031 inch sheet insulation such as a product trademarked Glastic plus two pieces of another insulator, 5 mil thick, such as a product trademarked Nomex. For a minimum BIL of 95 kV, common for an isolation rating between the high voltage coil 2 and the low voltage coil 4, the outside barrier 65 will be two thicknesses of 0.031 inch sheet insulation. The space between the insulating layers 60 is packed with a glass mat or felt edge material 66 to control the movement of the sheet conductors 62 during short circuit conditions. The glass felt edge material 66 could be any type of porous dielectric characterized by high temperature rating and stability. The dielectric constant must be greater than air to maintain proper voltage spacing requirements.

Examples of such a material 66 are Nomex 411, Cequin or other types of glass fibrous material. This material 66 functions to provide protection to the sheet conductors 62 against water entry or other contaminants and to provide electrical insulation properties for withstanding high voltage transients, in addition to providing., the mechanical rigidity of the ends of the coil for mechanical clamping and short circuit withstand forces. The material 66 must allow the sheet conductors to be impregnated with a suitable electrical insulating resin during the VPI process.

Supporting the outside layers next to the air channels 43, 45 of the multiple windings 42, 44, 46 with the outside barriers 64 results in increasing the overall radial dimensions of the windings and therefore the overall dimensions of the completed transformer 1. This extra thickness translates into extra material requirements for the core and coil material, including the conductors, insulating film, and resin used to encapsulate the windings. An alternative solution is to provide a reinforcing material along the edges of the outer insulating layers 60 next to the air channels 43, 45, for the distance Y, that will provide the stiffness to prevent this collapse of the edges.

Figure 6:
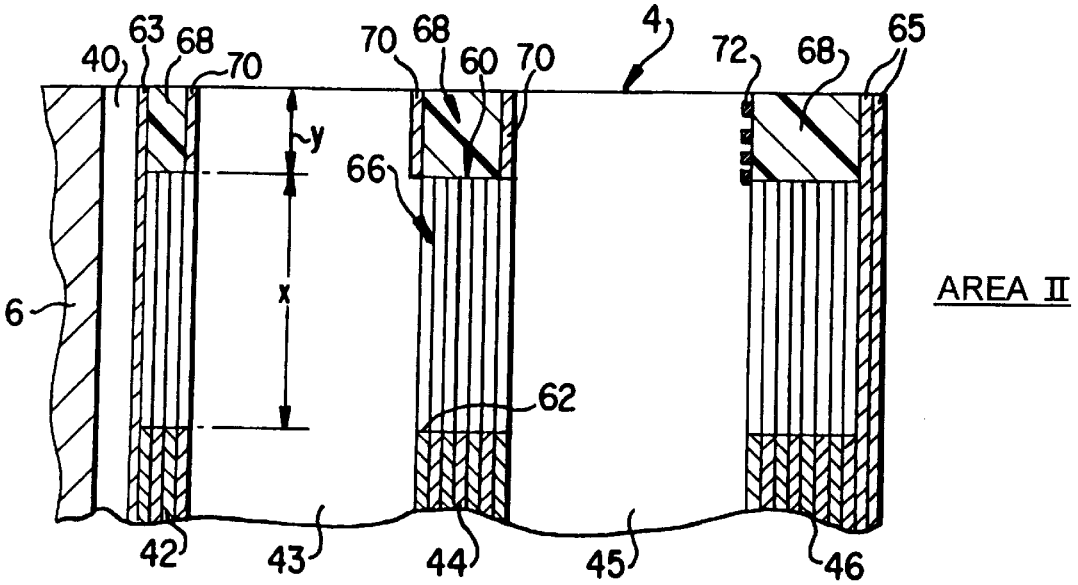
FIG. 6 is an enlarged view of area II detailing the upper portion of the low voltage coil depicted in FIG. 2, and illustrating an alternative method of reinforcing the edges of the insulating material.

Thus, FIG. 6 illustrates the use of Cequin strips 70 or reinforcing nylon strands 72 which will maintain the circular shape of the completed coil during the VPI processing and prevent the collapse over the air channels 43, 45. The end result will be a finished coil that will have a smaller diameter than one manufactured using the traditional Glastic material, using less material and therefore having lower cost.

After VPI processing, the completed coil is then baked in an oven at 350 degrees F. for two hours. An air dry resin is then applied in the void 68 to contour the ends of the windings, eliminating voids, and facilitating moisture run-off. Instead of using the dry resin, other coil finishing treatments and extensions can be employed in the voids 68 and 92. A moisture cured silicone RTV, an epoxy resin having suitable cure characteristics for the application, or a filled polyester resin could be substituted for the air dry resin. Another option requires a woven or braided fibrous rope being placed in the void 68 before the coil is subjected to the VPI process. The rope could be made of glass fiber, Nomex, or other heat resistant material.

While the specific embodiments have been illustrated and described, numerous modifications are possible without departing from the scope or spirit of the invention.

We claim:

1. A strip wound coil for use as a secondary winding in a transformer, said coil comprising;

a. a sheet conductor material;

b. a sheet insulating material having a width greater than said sheet conductor material, wound in an essentially circular shape coincident with said sheet conductor material a plurality of turns, forming a plurality of pockets at top and bottom portions of said strip wound coil between adjacent turns of said sheet insulating material;

c. a first lead conductor attached to one end of said sheet conductor material;

d. a plurality of cooling channels formed with spacers and interposed in said predetermined number of turns;

e. means for terminating said sheet insulator material coincident with said sheet conductor material and interposing a second lead conductor at said termination of said winding;

f. a sealant for sealing said formed pockets located on said bottom portion of said strip wound coil and means for sealing vertical seams formed between said sheet insulator material and said sheet conductor material in said formed air channels;

g. a polyester resin impregnated throughout said coil to form a high strength bond between adjacent turns, said high strength bond for preventing movement of said conductor sheet material during short circuit conditions; and h. wherein said sealant for preventing said impregnated resin from draining from said strip wound coil while said strip wound coil is curing.

2. The strip wound coil of claim 1 wherein said sealant is a highly thixotropic epoxy having a short cure time.

3. The strip wound coil of claim 2 wherein said formed pockets located on said top portion of said strip wound coil is sealed with a sealant after curing to prevent moisture penetration into the windings and prevent flashovers due to moisture condensation.

4. The strip wound coil of claim 1 wherein said conductor sheet material is aluminum.

5. The strip wound coil of claim 1 wherein said conductor sheet material is copper.

6. A strip wound coil for use in a dry insulated transformer, said strip wound coil comprising:

a. a sheet conductor material;

b. a sheet insulating material having a width greater than said sheet conductor material, wound in an essentially circular shape coincident with said sheet conductor material a plurality of turns, forming a plurality of pockets at top and bottom locations between adjacent windings of said sheet insulating material;

c. a first lead conductor attached to one end of said sheet conductor material;

d. a plurality of insulating spacers inserted at predetermined intervals after a first predetermined number of turns of said plurality of turns;

e. a first air channel formed between said plurality of insulating spacers and a next turn proceeding said first predetermined number of turns of said plurality of turns;

f. second insulating spacers inserted at predetermined intervals after a second predetermined number of turns of said plurality of turns;

g. a second air channel formed between said second insulating spacers and a next turn proceeding said second predetermined number of turns of said plurality of turns;

h. means for terminating said sheet insulator material coincident with said sheet conductor material and interposing a second lead conductor at said termination of said plurality of turns;

i. a sealant for sealing said formed pockets located on a bottom portion of said strip wound coil and means for sealing vertical seams formed between said sheet insulator material and said sheet conductor material in said formed air channels; and j. a resin impregnated throughout said coil to form a high strength bond between adjacent windings, said high strength bond for preventing movement of said conductor sheet material during short circuit conditions, said sealant to prevent leakage of said resin from said strip wound coil during a curing cycle.

7. The strip wound coil of claim 6 wherein said sealant is a highly thixotropic epoxy having a short cure time.

8. The strip wound coil of claim 7 wherein said formed pockets located on said top portion of said strip wound coil is sealed with a sealant after curing to prevent moisture penetration into the windings and prevent flashovers due to moisture condensation.

9. The strip wound coil of claim 5 wherein said conductor sheet material is aluminum.

10. The strip wound coil of claim 5 wherein said conductor sheet material is copper.

* * * * *